US005380950A

United States Patent [19]

Kunimoto

[11] Patent Number: 5,380,950

[45] Date of Patent: Jan. 10, 1995

[54] DIGITAL FILTER DEVICE FOR TONE CONTROL

[75] Inventor: Toshifumi Kunimoto, Hamamatsu, Japan

[73] Assignee: Yamaha Corporation, Hamamatsu, Japan

[21] Appl. No.: 136,492

[22] Filed: Oct. 14, 1993

Related U.S. Application Data

[63] Continuation of Ser. No. 575,278, Aug. 30, 1990, abandoned.

[30] Foreign Application Priority Data

Sep. 1, 1989 [JP] Japan ..... 1-224685

[51] Int. Cl.[6] ..... G10H 1/12

[52] U.S. Cl. ..... 84/661; 84/DIG. 9

[58] Field of Search ..... 84/622, 624, 625, 659, 84/660, 661, DIG. 9; 364/724.13, 724.16, 724.17

[56] References Cited

U.S. PATENT DOCUMENTS

| | | | |
|---|---|---|---|
| 4,215,617 | 8/1980 | Moorer | 84/625 X |
| 4,249,447 | 2/1981 | Tomisawa | 364/721 X |
| 4,265,158 | 5/1981 | Takahashi | 84/661 |
| 4,343,218 | 8/1982 | Futamase | 84/658 |
| 4,554,857 | 11/1985 | Nishimoto | 84/622 |
| 4,736,333 | 4/1988 | Mead et al. | 84/617 X |
| 4,736,663 | 4/1988 | Wawrzynck et al. | 84/627 |
| 4,766,561 | 8/1988 | Thompson et al. | 364/724.13 |
| 4,840,099 | 6/1989 | Kitagawa | 84/622 |
| 5,010,799 | 4/1991 | Tanaka et al. | 84/627 |
| 5,033,352 | 7/1991 | Kellogg et al. | 84/658 |
| 5,040,448 | 8/1991 | Matsubara et al. | 84/622 |

FOREIGN PATENT DOCUMENTS 55-45042 3/1980 Japan .

*Primary Examiner*—William M. Shoop, Jr.
*Assistant Examiner*—Brian Sircus
*Attorney, Agent, or Firm*—Spensley Horn Jubas & Lubitz

[57] ABSTRACT

A filter operation unit includes an operation circuit for receiving a digital tone signal and an operation parameter and digitally operating the tone signal with the operation parameter, a memory circuit for storing result of the operation and a connection switching circuit for establishing a filter operation algorithm by switching the mode of connection of the operation circuit and the memory circuit in response to a control signal. A control signal corresponding to a desired filter operation algorithm and an operation parameter for realizing a desired filter characteristic in the filter operation algorithm are generated by a control circuit and supplied to the filter operation unit. By switching the function of the filter operation unit, a filter characteristic corresponding to a desired filter operation algorithm can be selectively realized by employing one filter operation unit. It is also possible to realize plural basic filter operation algorithms on a time shared basis and control a tone signal with a filter characteristic obtained by combining these basic filter operation algorithms.

33 Claims, 3 Drawing Sheets

FILTER OPERATION UNIT 10

DIGITAL FILTER DEVICE FOR TONE CONTROL

This is a continuation of application Ser. No. 07/575,278 filed on Aug. 30, 1990, now abandoned.

BACKGROUND OF THE INVENTION

This invention relates to a digital filter device for tone control used in an electronic musical instrument or a tone generation device and, more particularly, to such digital filter device capable of realizing various filter characteristics as desired with a limited hardware structure.

An example of a filter having various characteristics employed in a tone color circuit of an electronic musical instrument is disclosed in Japanese Laid-open Patent Publication No. 55-45042. In this filter, plural voltage-controlled type filters having output terminals of different filter characteristics such as a high-pass filter output and a low-pass filter output are provided in parallel and the combination of individual filter characteristics is changed properly by changing the mode of connection of the respective voltage-controlled type filters such as by connecting a selected output terminal of one voltage-controlled type filter to an input terminal of another voltage-controlled type filter, and plural combined filter characteristics can thereby be selectively provided, However, the above-described prior art filter, in which plural voltage-controlled type filters having output terminals of different filter characteristics must be provided in parallel as a hardware structure, is costly and requires a construction of large size. Besides, in the prior art filter, it is not possible to establish a filter characteristic independently for each channel when a construction in which tone signals are generated on a time shared basis in plural channels is employed, and, accordingly, this prior art filter is not suited to a device in which a filter control is made tone by tone by key scaling or the like technique.

SUMMARY OF THE INVENTION

It is, therefore, an object of the invention to provide a digital filter for tone control capable of realizing various filter characteristics as desired with a simple construction by enabling the digital filter to change a filter operation algorithm freely with a limited hardware structure.

The digital filter device for tone control achieving the above object of the invention comprises a filter operation unit including an operation circuit for receiving a digital tone signal and an operation parameter and digitally operating the tone signal with the operation parameter, a memory circuit for storing result of the operation and connection switching means for establishing a filter operation algorithm by switching the mode of connection of the operation circuit and the memory circuit in response to a control signal, and control means for generating the control signal corresponding to a desired filter operation algorithm and generating the operation parameter for realizing a desired filter characteristic in the filter operation algorithm, a filter characteristic corresponding to a desired filter operation algorithm being selectively realized by employing one said filter operation unit.

In one aspect of the invention, the control means generates the control signal corresponding to plural basic filter operation algorithms on a time shared basis and generate also the operation parameters for realizing a desired filter characteristic in the respective filter operation algorithms on a time shared basis, basic filter characteristics corresponding to the basic filter operation algorithms being realized on a time shared basis by employing a common filter operation unit and a tone signal being controlled with a composite filter characteristic made by combining these basic filter characteristics.

The filter operation unit comprises the operation circuit, memory circuit and connection switching means and can establish a desired filter operation algorithm by switching the mode of connection of the operation circuit and memory circuit in response to a control signal. This control signal is selectively generated in accordance with a desired filter operation algorithm and an operation parameter for realizing a desired filter characteristic in the filter operation algorithm is also generated. These signals are supplied to the filter operation unit and the filter characteristic corresponding to the desired filter operation algorithm thereby is selectively realized. By changing a filter operation algorithm by using one filter operation unit, a tone signal can be controlled with a desired filter characteristic.

By generating control signals on a time shared basis in accordance with plural filter operation algorithms and generating operation parameters for realizing a desired filter characteristic in respective filter operation algorithms on a time shared basis, filter characteristics corresponding to the plural filter operation algorithms are realized on a time shared basis by supplying these signals to the filter operation unit. A tone signal can be controlled with a composite filter characteristic of these filter characteristics.

The hardware structure of the filter operation unit can therefore be a minimum one and various filter characteristics can be realized as desired with such simple hardware structure. In a case where the filter device is applied to a construction in which tone signals are generated on a time shared basis in plural channels, filter characteristics can be readily established independently for each channel by supplying the control signal and operation parameter to each channel on a time shared basis. The filter device according to the invention therefore is advantageous in a case where a filter operation is made tone by tone by key-scaling, touch response or the like technique.

A preferred embodiment of the invention will be described below with reference to the accompanying drawings.

BRIEF DESCRIPTION OF THE DRAWINGS

In the accompanying drawings.

DESCRIPTION OF A PREFERRED EMBODIMENT

Figure 1:
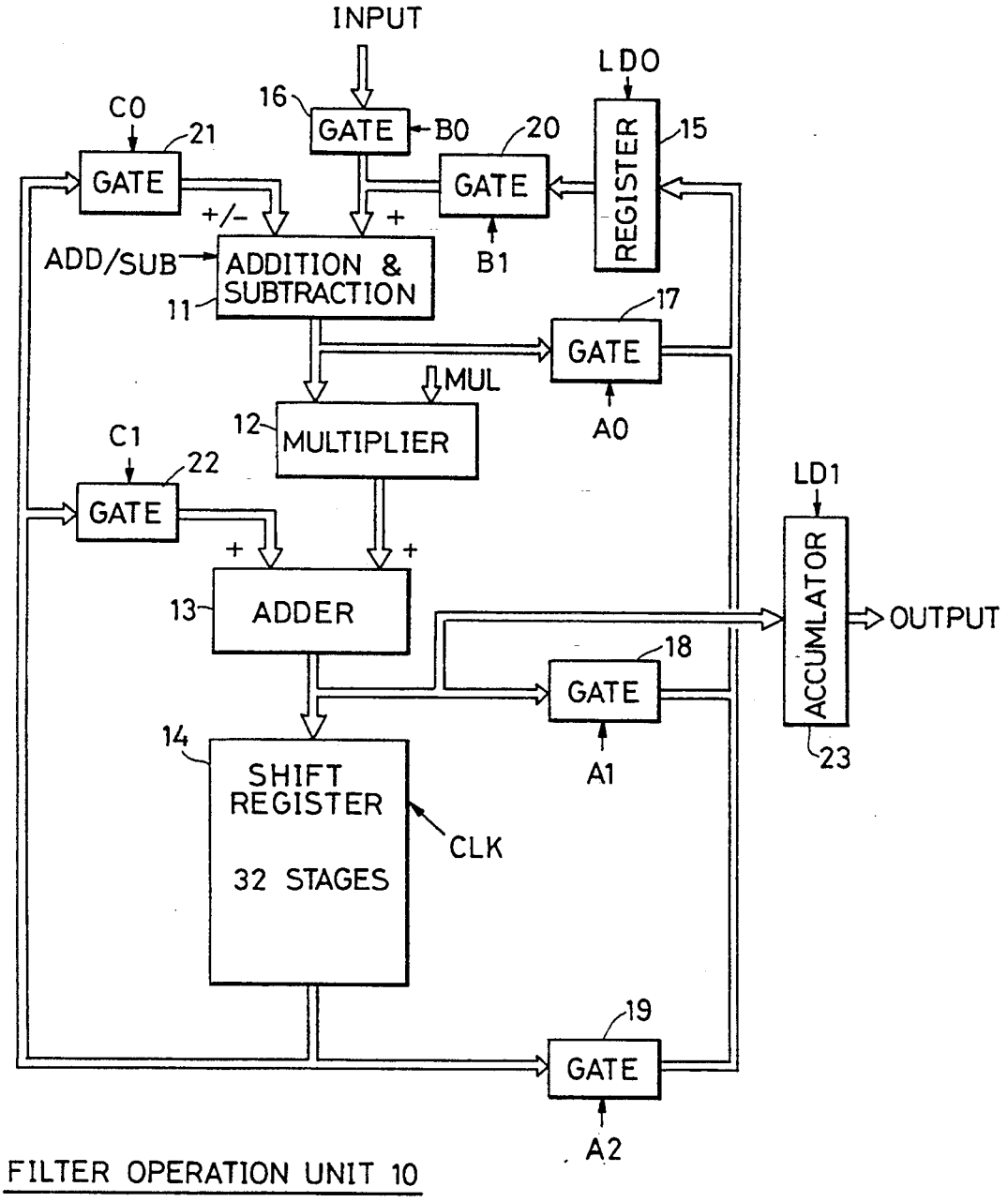
FIG. 1 is a block diagram showing an embodiment of a filter operation unit in the digital filter device for tone control according to the invention.

Referring first to FIG. 1, a filter operation unit 10 will be described. This filter operation unit 10 includes an addition and subtraction circuit 11, a multiplier 12 and an adder 13 for receiving a tone signal and an operation parameter and digitally operating the tone signal with the operation parameter, a shift register 14 and a register 15 which constitute a memory circuit for storing result of the operation, and gates 16 to 22 which constitute the connection switching means for establishing a filter operation algorithm by switching the mode of connection of the respective operation circuits and memory circuit in response to a control signal. The gates 16 to 20 are made of tristate buffers which conduct an input signal therethrough when a control signal is being applied thereto and put its output in a floating state to enable a wired-OR connection when a control signal is not being applied thereto.

The shift register 14 has memory stages each of which stores result of operation at a corresponding one of time division time slots. In this embodiment, four time slots are used for filtering one sample point amplitude value of a tone signal. Two basic filter operation algorithms corresponding to two basic filter characteristics are executed and an operation algorithm for realizing a composite filter characteristic made by combining these basic filter characteristics is executed. Further, in this embodiment, tone signals for sixteen tones can be processed on a time shared basis. For this purpose, the shift register 14 requires two memory stages storing results of operation of two basic filter operation algorithms for a tone signal of one tone, so that the shift register 14 has $16\times2=32$ memory stages in total.

Figure 3:
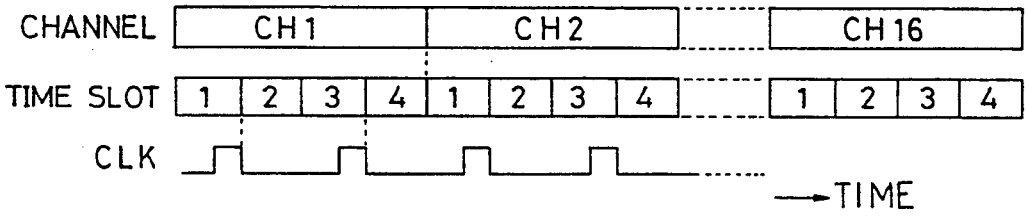
FIG. 3 is a time chart showing an example of a time division processing timing.

FIG. 3 shows relationship between time division timings CH1 to CH16 for sixteen tones (sixteen channels) and operation time slots four of which are allotted to each tone. A shift control clock pulse CLK of the shift register 14 is given at a ratio of one to every two time slots.

Figure 4:
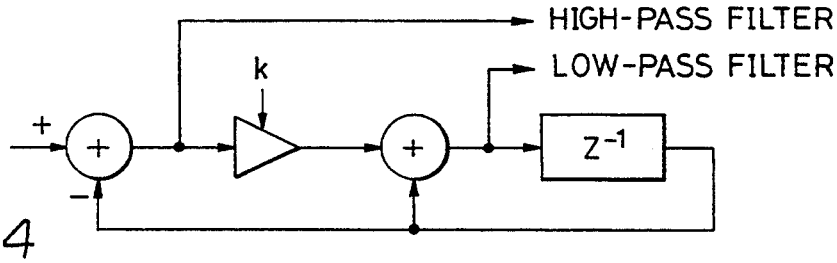
FIG. 4 is a diagram showing a basic structure of the filter operation unit of FIG. 1.

In this embodiment, the filter operation unit 10 consists of a basic construction as shown in FIG. 4 which is capable of selectively performing a basic operation algorithm of a low-pass filter and a high-pass filter. The filter operation unit 10 includes addition means (corresponding to the adder 13) for obtaining a sum of convolution operation of one multiplication means (corresponding to the multiplier 12) for multiplying a filter coefficient k and one-stage delay means $z^{-1}$ (corresponding to the shift register 14) and addition and subtraction means for circulation (corresponding to the addition and subtraction circuit 11). The low-pass filter output is derived from the convolution sum addition means (corresponding to the adder 13) and the high-pass filter output is derived from the addition and subtraction means for circulation (corresponding to the addition and subtraction circuit 11). A low-pass filter and a high-pass filter can be respectively realized by this basic operation algorithm.

A connection for realizing the operation algorithm of the high-pass filter and the low-pass filter in the operation unit 10 of FIG. 1 is shown below.

High-pass filter conditions:

Control signals B0, A0, C0 and C1 for the gates 16, 17, 21 and 22 are turned to "1" to open these gates 16, 17, 21 and 22 (the gates 18, 19 and 20 remain closed).

A desired filter coefficient k (H) determining a cut-off frequency of a high-pass filter is applied to a multiplier input MUL of the multiplier 12.

A control signal ADD/SUB for the addition and subtraction circuit 11 is turned to "0" to introduce the subtraction mode. A load pulse LD0 of the register 15 is turned to "1" and an operation output is loaded.

An input tone signal thereby is applied to a + input of the addition and subtraction circuit 11 through the gate 16 and the result of operation for the preceding sample point provided by the shift register 14 is applied to a ± input of the addition and subtraction circuit 11. The addition and subtraction circuit 11 is controlled to function as a subtractor in response to the control signal ADD/SUB and subtracts the result of operation for preceding sample point supplied from the gate 21, from current sample point tone signal amplitude value supplied from the gate 16. The output of the addition and subtraction circuit 11 is applied to the multiplier 12 in which the filter coefficient k(H) is multiplied. The result of multiplication is applied to the adder 13 in which it is added to the result of operation for the preceding sample point. The result of addition is loaded in the shift register 14 and delayed until a next sampling timing. The output of the addition and subtraction circuit 11 is derived as a high-pass filter output from the gate 17 and temporarily stored in the register 15.

Low-pass filter conditions:

The control signals B0, A1, C0 and C1 for the gates 16, 18, 21 and 22 are turned to "1" to open these gates 16, 18, 21 and 22 (The gates 17, 19 and 20 remain closed).

A desired filter coefficient k(L) determining the cut-off frequency of the low-pass filter is applied to the multiplication input MUL of the multiplier 12.

The control signal ADD/SUB of the addition and subtraction circuit 11 is turned to "0" to introduce the subtraction mode. The load pulse LD0 of the register 15 is turned to "1" to load the operation output in the register 15.

An input tone signal thereby is applied to the + input of the addition and subtraction circuit 11 through the gate 16 and the result of operation for the preceding sample point provided by the shift register 14 is applied to the ± input of the addition and subtraction circuit 11 through the gate 21. The addition and subtraction circuit 11 is controlled to function as a subtractor by the control signal ADD/SUB and subtracts the result of operation for preceding sample point supplied from the gate 21, from current sample point amplitude value supplied from the gate 16. The output of the addition and subtraction circuit 11 is applied to the multiplier 12 in which a filter coefficient k(L) is multiplied. The result of multiplication is applied to the adder 13 in which it is added to the result of operation for the preceding sample point supplied from the shift register 14 through the gate 22. The result of addition is loaded in the shift register 14 and delayed until a next sampling timing. The output of the addition and subtraction circuit 11 is derived as the low-pass filter output through the gate 18 and stored temporarily in the register 15.

Description will now be made about examples of algorithm for realizing a composite filter characteristic made by combining the outputs of the low-pass filter and the high-pass filter produced in the above described manner.

FIGS. 5*a* to 5*d* show examples of algorithm which can be realized in the filter operation unit 10. In these figures, the blocks designated by "H/L" represent low-pass filter elements or high-pass filter elements and the triangular blocks represent elements of the amplitude coefficient multiplication means. The amplitude coefficient multiplication means corresponds to the multiplier 12 in the filter operation unit 10.

By way of example, a connection for realizing the algorithm of FIG. 5*b* will be explained. In this case, control signals and operation parameters are generated at four time slots 0 to 3 as shown in the following Table 1.

TABLE 1

| | Time slots | | | |
|---|---|---|---|---|
| | 0 | 1 | 2 | 3 |
| A0 | 1 | 0 | 0 | 0 |
| A1 | 0 | 0 | 1 | 0 |
| A2 | 0 | 0 | 0 | 0 |
| B0 | 1 | 0 | 1 | 0 |
| B1 | 0 | 1 | 0 | 1 |
| C0 | 1 | 0 | 1 | 0 |
| C1 | 1 | 0 | 1 | 0 |
| LD0 | 1 | 0 | 1 | 0 |
| LD1 | 0 | 1 | 0 | 1 |
| ADD/SUB | 0 | — | 0 | — |
| MUL | k(H) | AM1 | k(L) | AM2 |

The conditions of the control signals and operation parameters at the time slot 0 are the above described high-pass filter conditions, so that the high-pass filter output is temporarily stored in the register 15.

At the next time slot 1, the gate 20 is opened by the logical level "1" of the control signal B1 and, therefore, the high-pass filter output signal which has been temporarily stored in the register 15 is applied through the addition and subtraction circuit 11 to the multiplier 12 in which it is multiplied with the amplitude coefficient AM1. The multiplication output is supplied to an accumulator 23 through the adder 13. Since the gates 21 and 22 are closed by the controls signals C0 and C1 which are "0", the addition and subtraction circuit 11 and the adder 13 merely pass a signal applied to one input thereof. The accumulator 23 loads the operation output by the logical level "1" of the load pulse LD1. In this manner, the data derived by multiplying the high-pass filter output with the amplitude coefficient AM1 is loaded in the accumulator 23.

At the next time slot 2, the conditions of the control signals and operation parameters are the conditions of the above described low-pass filter conditions, so that the low-pass filter output is temporarily stored in the register 15.

At the next time slot 3, the gate 20 is opened by the logical level "1" of the control signal B1 and the low-pass filter output signal which has been temporarily stored in the register 15 is applied through the addition and subtraction circuit 11 to the multiplier 12 in which the amplitude coefficient AM2 is multiplied. The multiplication output is supplied to the accumulator 23 through the adder 13. Since the gates 21 and 22 are closed by the control signals C1 and C2 which are "0", the addition and subtraction circuit 11 and the adder merely pass a signal applied to one input thereof. The accumulator 23 loads the operation output by the logical level "1" of the load pulse LD1. In this manner, the data derived by multiplying the low-pass filter output with the amplitude coefficient AM2 is loaded in the accumulator 23 in which this data is added to the data derived by multiplying the high-pass filter output with the amplitude coefficient AM1 which has already been loaded.

Figure 5A:
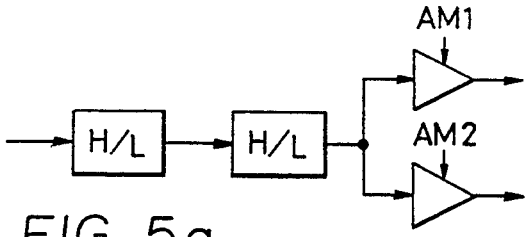
FIGS. 5*a* to 5*d* are schematic diagrams showing examples of algorithms which can be realized in the filter operation unit of FIG. 1.
Figure 5B:
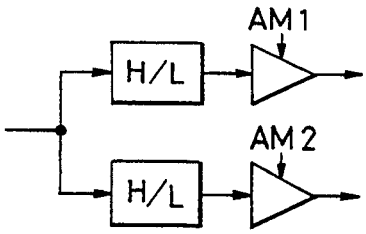

In the above described manner, the data derived by multiplying the high-pass filter output with the amplitude coefficient AM1 and the data derived by multiplying the low-pass filter output with the amplitude coefficient AM2 at the time slots 1 and 3 are provided by the adder 13 whereby the algorithm as shown in FIG. 5*b* is realized. In the above described example, the two outputs are added together in the accumulator 23. Alternatively, the two outputs may be provided separately instead of being added together as shown in FIG. 5*b*. In such case where the two outputs are provided separately, separate latch circuits or registers may be employed instead of the accumulator 23.

Figure 5C:
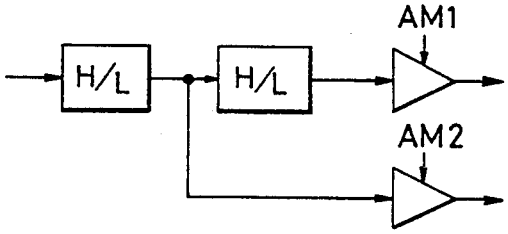
Figure 5D:
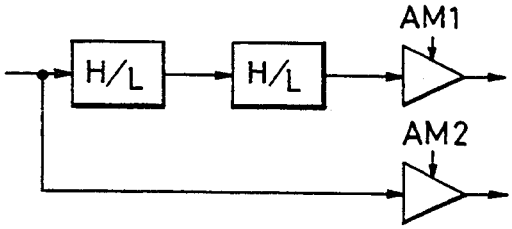

In the same manner, the other examples of algorithm shown in FIGS. 5*a*, 5*c* and 5*d* can also be realized by providing suitable control signals and operation parameters. In the case of FIG. 5*a* in which an output of a certain filter element is applied directly to a next filter element, loading and outputting in the register 15 are performed at the same time slot so that a proper arrangement in the circuit design such as provision of a two-stage latch should be made in the register 15 for preventing cancellation of an output signal. In FIG. 5*a*, two amplitude coefficients AM1 and AM2 are respectively multiplied in separate systems. This is merely an example for showing that such multiplication in separate systems can be realized by the employment of four time slots. The invention includes a construction in which one amplitude coefficient is multiplied in only one system.

As will be apparent from the foregoing description, the two filter elements need not be different from each other but may be of the same filter characteristic. For example, both of the two may be high-pass filters or low-pass filters. Their cut-off frequencies may be set at a suitable frequency depending upon the purpose of the filters, namely they may be set at the same frequency or may differ from each other.

Figure 6A:
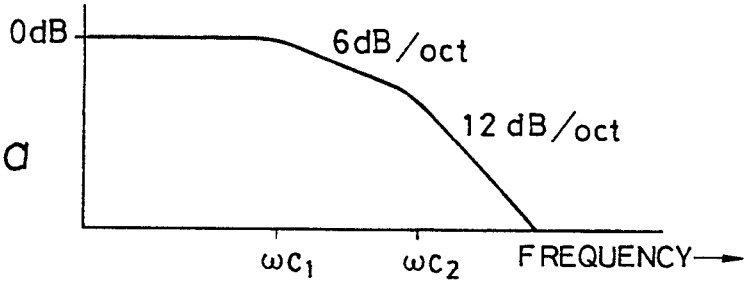
FIGS. 6*a* and 6*b* are diagrams showing examples of amplitude-frequency characteristic in an algorithm realized in the filter operation unit of FIG. 1.
Figure 6B:
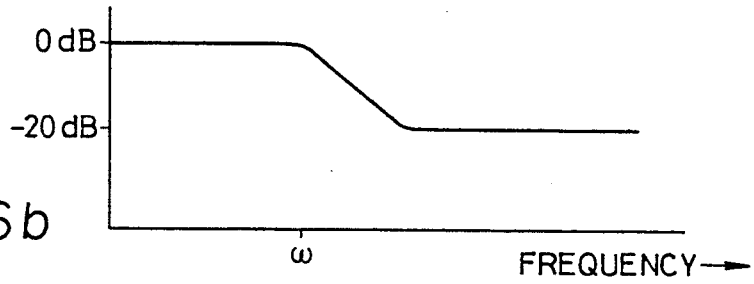

FIGS. 6*a* and 6*b* show examples of filter characteristics that can be realized. FIG. 6*a* shows an example of a composite filter characteristic obtained in a case where a staggering type low-pass filter is provided in the cascade-connection type algorithm as shown in FIG. 5*a*. $\omega c1$ and $\omega c2$ represent cut-off frequencies of the respective low-pass filters. FIG. 6*b* shows an example of a composite filter characteristic obtained in a case where cascade-connection type filter elements are used as low-pass filters and their cut-off frequency is set at the same frequency $\omega c$ which is at the characteristic of 12 dB/octave, the amplitude coefficient AM1 of one system is set at 0 dB and the amplitude coefficient AM2 of the other system is set at −20 dB, and outputs of the two systems are added together.

Figure 2:
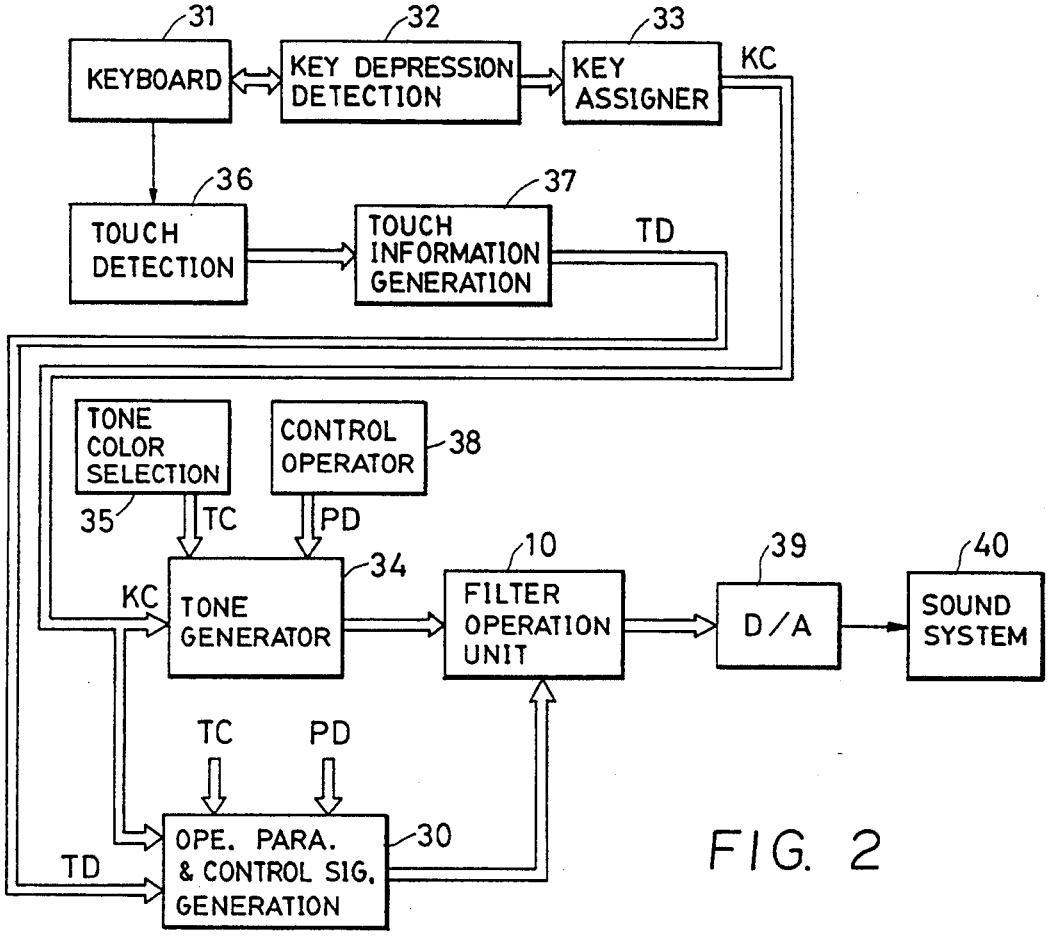
FIG. 2 is a block diagram showing the entire structure of an example in which the digital filter device including the filter operation unit of FIG. 1 is used in an electronic musical instrument.

Description will now be made about the circuit of FIG. 2. The filter operation unit 10 is the one which has been described with reference to FIG. 1. Control signals A0, A1, A2, B0, B1, C0, C1, LD0, LD1 and ADD/SUB and operation parameters (filtre coefficient k(H) and k(L) and amplitude coefficients AM1 and AM2) which are supplied to the filter operation unit 10 are generated by an operation parameter and control signal generation circuit 30.

A key which has been depressed in a keyboard 31 is detected by a key depression detection circuit 32 and sounding of the tone of the depressed key is assigned to any of sixteen channels in a key assigner circuit 33. A tone generator 34 can generate digital tone signals in the sixteen channels on a time shared basis and generates a digital tone signal having a tone pitch corresponding to the key assigned to any one of the channels with a tone source waveform corresponding to a tone color selected by a tone color selection circuit 35. The digital tone signal which has been generated by the tone generator 34 is applied to the filter operation unit 10. Touch detection means 36 detects key-touch of the key which has been depressed in the keyboard 31 and causes a touch information generation circuit 37 to produce touch information TD corresponding to the detected touch.

The operation parameter and control signal generation circuit 30 receives tone color information TC representing a tone color selected by the tone color selection circuit 35, key code KC representing a key which has been assigned to any one of the channels, touch information TD and output data PD of a control operator 38 which is operated by a player and, responsive to these signals, generates the above described control signals A0, A1, A2, B0, B1, C0, C1, LD0, LD1 and ADD/SUB and operation parameters (filter coefficients k(H) and k(L) and amplitude coefficients AM1 and AM2). Generation of these control signals and operation parameters is performed independently in respective channels on a time shared basis and, in one channel, is performed at a proper time slot of four time slots as shown in FIG. 3. By this arrangement, the filter operation algorithm and the amplitude/frequency characteristic can be established in accordance with a selected tone color, can be subjected to key-scaling in accordance with the tone pitch (or the tone range) of a generated tone, can be subjected to a touch response control in response to tile key touch or can be controlled in accordance with manipulation of an operator by a player. The key scaling and touch response can be performed independently tone by tone (i.e., channel by channel). In a case where a one-stage keyboard is divided in plural key ranges and a different tone color setting is made in each key range, control signals and operation parameters for establishing a proper filter operation algorithm and amplitude-frequency characteristic can be generated in accordance with detection of the key range in response to the key code KC and in accordance with the tone color information TC.

The filter operation unit 10 is set at the filter operation algorithm and amplitude/frequency characteristic in response to these control signals and operation parameters, and filters a digital tone signal supplied from the tone generator 34. The filtered output is supplied to a digital-to-analog converter 39 and thereby is converted to an analog signal and thereafter is supplied to a sound system 40.

A specific circuit construction of the filter operation unit 10 is not limited to the one shown in FIG. 1 but may be modified in a suitable form. The number of time sharing filter elements for performing the process for one sample point is not limited to two.

As described so far, according to the present invention, it is possible to realize various filter characteristics as desired with a simple construction by enabling the digital filter to change a filter operation algorithm freely with a limited hardware structure. Further, when the present invention is applied to a construction in which tone signals are generated on a time shared basis in plural channels, filter characteristics can be readily established independently for each channel by supplying the control signal and operation parameter to each channel on a time shared basis, and hence, the invention is advantageous in a case where a filter operation is made tone by tone by key-scanning, touch response or the like technique.

What is claimed is:

1. A tone generator generating a digital tone signal including a digital filter device having a filter characteristic corresponding to a selected desired filter operation algorithm for tone control of an input tone signal comprising:

a filter operation unit responsive to the tone signal including an operation circuit having operators for performing digital operations and switchable modes of connection between the operators, wherein the operators are multipliers and adders and the operators are coupled to each other to perform one of plural basic filtering operation algorithms, the operation unit receiving the digital tone signal and an operation parameter and digitally operating upon the tone signal with the operation parameter, a memory circuit for storing at least a result of the operation and connection switching means for establishing the basic filter operation algorithm by switching the mode of connection between the operators and the memory circuit in response to a control signal; and control means for generating the control signal corresponding to a desired filter operation algorithm and generating the operation parameter for realizing the desired filter characteristic in the filter operation algorithm upon the tone signal.

2. A tone generator device as defined in claim 1 wherein said control means generates the control signals corresponding to plural filter operation algorithms on a time shared basis and also generates the operation parameters for realizing a desired filter characteristic in the respective filter operation algorithms on a time shared basis, the filter operation algorithms being realized on a time shared basis by employing the common filter operation unit and wherein a tone signal after being operated on by a first filter algorithm is operated on by a second filter algorithm to provide a composite filter characteristic made by combining these filter characteristics of the first and second filter algorithms.

3. A tone generator device as defined in claim 2 wherein the control signals include a first control signal for establishing an operation algorithm to realize a first filter characteristic and a second control signal for establishing a second operation algorithm to realize a desired combination of respective filter characteristics.

4. A tone generator device for tone control of tones produced in plural time channels on a time shared basis as defined in claim 1 wherein said filter operation unit receives tone signals of plural time channels on a time shared basis and said control means generates a control signal and an operation parameter for establishing an operation algorithm and a filter characteristic independently and respectively for each respective channel.

5. A tone generator device for generating a tone signal and having a digital filter for realizing a composite filter characteristic having poles and zeros corresponding to a combination of plural basic filter characteristics, the basic filter characteristic having fewer of at least one of poles and zeros comprising:

a filter operation unit including an operation circuit for receiving the tone signal and the unit having internal functional blocks, each block performing only one basic mathematical or delay operations and the blocks configured with respect to each other to implement different basic filter characteristics, the selection of the characteristic caused by changing at least one alterable internal connection between the blocks, the operation circuit receiving a tone signal in digital form and an operation parameter and digitally operating on the tone signal with the operation parameter, a memory circuit for storing a result of the operation, and connection altering means for establishing a basic filter operation algorithm by altering the mode of connection of the operation circuit and the memory circuit in response to a control signal; and control means for generating the control signal at a first time corresponding to plural basic filter operation algorithms on a time shared basis to realize connection of the operation circuit corresponding to a basic filter operation algorithm, on a time shared basis to realize a desired filter characteristic in the respective filter operation algorithms, and further generating the control signal at a second time for establishing an operation algorithm to realize a desired combination of the basic filter characteristics, thereby said basic filter characteristics corresponding to the basic filter operation algorithms being realized on a time shared basis by commonly employing said filter operation unit and a tone signal being controlled with said composite filter characteristic made by combining these basic filter characteristics.

6. A tone generator device as defined in claim 5 and for tone control of tones produced in plural time channels on a time shared basis, wherein said filter operation unit receives tone signals of plural time channels on a time shared basis and said control means generates a control signal and an operation parameter for establishing an operation algorithm and a filter characteristic independently for each respective channels thereby allowing composite filtering with composite algorithms.

7. A method for generating a filtered tone signal according to a desired filter characteristic pursuant to a selectable algorithm to alter the tone color of the tone signal, the method comprising:

generating a tone signal having at least two constituent frequencies;

supplying a digital operation circuit having an output and comprised of at least two different digital operators, the digital operators having inputs and outputs and being one of a group consisting of delay elements, adders and multipliers, data paths coupling the outputs of some of the operators to some of the inputs for providing plural different basic filter algorithms and control circuitry responsive to control signals for altering the data paths between the operators in response to control signals that select the filter algorithm, wherein the digital operators are responsive to the tone signal;

receiving control signals and at least one operation parameter;

altering one data path in response to the control signal to perform the desired filtering algorithm upon the generated tone signal with the operation parameter by the different digital operators; and supplying an output digital tone signal, wherein the output digital signal corresponds to the input digital tone signal filtered according to the selected filtered algorithm with the at least one operation parameter.

8. The method of claim 7, wherein the method further includes time sharing the digital operation circuit with a plurality of digital tone input signals, whereby each tone input signal is digitally filtered according to the selected algorithm specified by one or more control signals and the at least one received operation parameter.

9. The method of claim 7, wherein the method further includes time sharing of the digital operation circuit so that the output tone signal is fed back on a time shared basis to the operation circuit and the circuit receives at least a second control signal for selecting a second filter algorithm and a second operation parameter, whereby the output signal of the operation circuit corresponds to the input tone signal filtered by a composite filter comprised of the first and second filter algorithms using the operation parameters.

10. In an electronic musical instrument having circuitry that provides key on and off information, key code information, tone color information, and at least one of key touch and key after touch information, and a digital tone signal, the improvement comprising:

an operation parameter and control signal generator responsive to at least one of the key code, touch, after touch and tone color information to produce at least one operation parameter and at least one control signal; and a filter operation unit performing designatable filter algorithms having an input for receiving the tone signal, at least two digital operators, one of the operators being an adder and another of the operators being a multiplier, an alterable memory, controllable data paths providing different connections between the adder and the multiplier and the alterable memory to implement a plurality of different basic filter algorithms in only one unit, an output, and means for rerouting the data paths between the memory, the digital operators, the input and the output, the means rerouting of the data paths in response to the control signal to thereby designate at least part of the filter algorithm to filter the input signal.

11. The electronic musical instrument of claim 10 wherein at least one of the digital operators performs an operation on the input tone signal with the operation parameter to thereby filter the input signal.

12. The electronic musical instrument of claim 10, wherein the parameter and control signal generator outputs at least a second control second for designating a second filter algorithm, the filter operation unit is used in a time shared basis and further the filter output is fed back to the input means so that the second filter algorithm is performed on the output of the filter so that a composite filter algorithm is achieved.

13. The electronic musical instrument of claim 12, wherein the two filter algorithms are both high pass filter algorithms.

14. The electronic musical instrument of claim 12, wherein the two filter algorithms are low pass filter algorithms.

15. The electronic musical instrument of claim 12, wherein one of the filter algorithms is a high pass filter algorithm and the other is a low pass filter algorithm.

16. A tone generator generating a plurality of tone signals having a plurality of frequencies in each of the tone signals, with a filter for filtering a plurality of different tone signals provided in a plurality of channel times in a time shared basis, the filter comprising:

at least one input responsive during successive channel times to each tone signal to be filtered;

a digital operation unit including at least one alterable memory, a digital adder and multiplier for performing operations on the tone signal to be filtered during a channel time, an output, alterable data paths between at least some of the input, the output, the digital adder and multiplier and the alterable memory arranged with respect to each other such that the operation unit implements both first and second basic different filter algorithms based upon the alteration of the data paths in only one unit, a controller that controls the alteration of the data paths, whereby the alteration of the data path results in the digital operation unit filtering the appropriate tone signal pursuant to the filtering algorithm implemented by the data paths.

17. The tone filter of claim 16, wherein the digital operation filter unit further includes an alterable feedback data path from the output, whereby a composite operation algorithm may be achieved.

18. A method for altering within a tone generator the filtering algorithm for filtering generated tone signals having a spectrum of frequencies, the instrument having a means for selecting between the different filtering algorithms, a circuit having an input and an output, a plurality of different adders and at least one multiplier, alterable memory, and a plurality of controllable modes of connection between the memory, the adders and the multiplier, the input, and the output, the operators and the memory being connected with each other to perform at least two different basic filtering algorithms, the method comprising:

altering the modes of connection between the memory, the adders and the multiplier, the input and the output in response to the means for selecting the algorithm to achieve the selected algorithm;

processing the input signal in the circuit with the selected algorithm; and supplying at the output a filtered version of the input signal according to the selected algorithm.

19. The method of claim 18, wherein the instrument has circuitry supplying at least one of selectable key touch, after touch, key code and tone color information, the means for selecting between the different filtered versions comprises means responsive to said information.

20. A tone generator generating a digital tone signal and including a filter unit to filter an input tone signal according to a desired filter algorithm, the tone generator including input means for specifying the desired filtering algorithm, the filter unit comprising:

an operation unit comprising at least one delay element and an adder and a multiplier coupled together to perform the same sequence of operations and gateable data paths connecting the operators and the delay element such that selection of two different data paths selects two different basic filter algorithms; and a controller to select the specific data paths to thereby implement the desired filter algorithm.

21. A tone generator generating a digital tone signal to be filtered by a filter unit to filter an input tone signal according to a desired filter algorithm, wherein the tone generator includes means for selecting the desired filter algorithm, the filter unit comprising:

a plurality of arithmetic operators each having inputs and an output and the operators coupled to each other to implement a specified sequence of arithmetic operations;

a delay element responsive to the output of one of the operator and at least one of the operators is responsive to the delay element; and at least two different outputs coupled to the output of different operators such that a first basic filter algorithm is provided at the first output and a second basic filter algorithm is provided at the second output.

22. A tone generator generating a tone signal and including a filter unit responsive to control signals capable of performing a plurality of different basic filtering functions, the filtering unit filtering the tone signal and comprising:

a plurality of operators including:

a first adder having at least two inputs and one output;

a multiplier having at least two inputs and one output;

a second adder having at least two inputs and one output;

an accumulator coupled to the output of the second adder;

a delay element coupled to the output of the first adder so that the unit is capable of operating in a time division multiplexing;

and switchable data paths that may be opened and closed coupling the output of the delay element, first adder and the second adder to at least one of the inputs of the first adder so that different basic filtering algorithms may be selected in response to the opening and closing of selected data paths.

23. The tone generator unit of claim 22, wherein the different basic filtering algorithms include high pass and low pass filtering.

24. The tone generator unit of claim 22, wherein the switchable data paths in response to a predetermined control signal cause the filtered output of a first basic filter function to be provided to the input of at least one of the adders and multipliers to perform a second basic filtering function.

25. A tone generator for generating a tone signal and subsequently modifying the tone by filtering the tone signal to provide a filtered output signal in response to at least one operation parameter provided to the filtering component, the filtering component comprising:

at least two basic digital filters, each of the filters including operating parameter supplying means coupled to operating means having data paths and gates altering the data paths within the operating means in response to different operation parameters supplied by the supplying means and can variably realize desired basic filter characteristics by controlling at least one operation parameter;

connection mode controlling means controlling the mode of connections between the basic digital filters in accordance with a selected mode of connection between the filters based upon at least one control parameter; and a control parameter supplying means for supplying the control parameter.

26. The tone generator of claim 25, wherein the filtering component receives a plurality of input signals in a time division multiplexing basis and provides filtered output signals based upon those input signals on a time division multiplexing basis.

27. The tone generator of claim 26, wherein each basic digital filter includes a plurality of adders having outputs and inputs, wherein an input of one adder is coupled to the output of the other adder, at least one multiplier and at least one register having outputs and a plurality of switchable data paths coupling the output of the multiplier and the register to the input of the adder.

28. A tone generator generating a signal having a spectrum and the generator including a filtering circuit for filtering the tone signal to alter the spectrum of the signal and to provide a circuit output, the circuit having an output and comprising:

an adding means and a multiplier each comprising two inputs and one output, and a register having one input and one output, the adding means, the multiplier and the register configured to perform the calculation:

$$CircuitOutput = C \cdot (A + B) + D$$

where, A, B and D are inputs to the adding means, C is an input to the multiplier;

a plurality of gates coupling the inputs of the adding means to the outputs of the register and the multiplier, the gates operating in response to control signals to implement different basic filtering functions; and and means for applying the control signals to the gates such that the output of the multiplier performs any of a plurality of basic digital filtering algorithms based upon the control signals to filter the input signal to provide a filtered output signal.

29. The tone generator as described in claim 28, wherein the adding means comprises a pair of adders each having inputs and an output, the output of the first adder being coupled by a gate to the input of the multiplier and the output of the multiplier being coupled to an input of the second adder.

30. The tone generator as described in claim 29, wherein at least one of the adders is capable of doing subtraction.

31. The tone generator of claim 22, wherein the tone generator generates a plurality of tones in a time multiplexed manner and the switching of the data paths is accomplished in a time multiplexed manner to attain different filter characteristics in the time multiplexed manner.

32. The tone generator of claim 25, wherein a plurality of tones are generated in a time multiplexed manner and the filters filter the different tones in a time multiplexed manner and wherein the control parameters are also supplied in a time multiplexed manner to alter the filtering characteristics of the filters in a time multiplexed manner.

33. The tone generator of claim 28 wherein the tones and the control signals are applied to the filter in a time division multiplexed manner such that different filter characteristics are achieved for filtering the signals in a time division multiplexed manner.

* * * * *